US007400740B2

(12) United States Patent
Steere et al.

(10) Patent No.: US 7,400,740 B2
(45) Date of Patent: Jul. 15, 2008

(54) CORE CAP FOR LOUDSPEAKER

(75) Inventors: John F. Steere, Martinsville, IN (US); Steven W. Hutt, Bloomington, IN (US); Ronald E. Fenwick, Bloomington, IN (US)

(73) Assignee: Harman International Industries, Inc., Northridge, CA (US)

( * ) Notice: Subject to any disclaimer, the term of this patent is extended or adjusted under 35 U.S.C. 154(b) by 642 days.

(21) Appl. No.: 11/057,873

(22) Filed: Feb. 14, 2005

(65) Prior Publication Data

US 2006/0182305 A1 Aug. 17, 2006

(51) Int. Cl.
*H04R 1/00* (2006.01)
*H04R 9/06* (2006.01)

(52) U.S. Cl. ..... 381/414; 381/412

(58) Field of Classification Search ..... 381/396, 381/412, 420, 150, 414
See application file for complete search history.

(56) References Cited

U.S. PATENT DOCUMENTS 7,079,665 B2 * 7/2006 Shimomura et al. ..... 381/396
7,149,322 B2 * 12/2006 Kuribayashi et al. ..... 381/412
7,224,817 B2 * 5/2007 Kosuda ..... 381/412

FOREIGN PATENT DOCUMENTS

JP 2001339790 A * 12/2001

* cited by examiner

*Primary Examiner*—Brian Ensey
(74) *Attorney, Agent, or Firm*—Brinks Hofer Gilson Lione

(57) ABSTRACT

A core cap or top plate for use with loudspeakers that includes offset adhesive control grooves on the opposite faces of the disk-like core cap is disclosed. The grooves are offset from one another by a distance that makes the smallest dimension between any feature of the grooves about the same as the nominal thickness of the core cap. The core cap increases the magnetic flux capacity over prior art core cap designs, while maintaining features advantageous to error-proof the orientation of the core cap in the loudspeaker.

28 Claims, 4 Drawing Sheets

CORE CAP FOR LOUDSPEAKER

BACKGROUND OF THE INVENTION

1. Field of Invention

The invention relates generally to a loudspeaker of the type having a magnetic circuit comprising a permanent magnet upon which is positioned a top plate or "core cap." In particular, the invention relates to an improved core cap that increases its capacity to use the magnetic energy available from the magnet, while maintaining advantageous features for simplifying loudspeaker assembly.

2. Related Art

Loudspeakers may have a shell-pot design. Such loudspeakers are commonly of physically small dimensions and are used in loudspeaker applications for reproducing sound in the mid-to-high frequency ranges, such as a tweeter, for example. In FIG. 1, a simplified cross-section of a typical loudspeaker 100 of this type is shown.

The loudspeaker 100 is a diaphragm-type loudspeaker. Loudspeaker 100 includes a magnetic circuit 102 that produces a stationary magnetic field of high flux density in a narrow, working air gap 104 where a movable, current-carrying voice coil 106 is located. A force induced by the interaction between the current carried in the voice coil 106 and the magnetic flux in the air gap 104 actuates an assembly 108 for producing sound. The sound producing assembly 108 comprises the voice coil 106, a diaphragm or cone 112, and a suspension or surround 116. The diaphragm 112 moves in response to the force and displaces air to produce a sound.

A shell-pot 118 comprises a lipped, radial basin inside which is located a generally cylindrical permanent magnet 120. A disk-like core cap 122 is attached to the top of the magnet 120. Typically, the core cap 122 has a slightly greater diameter than the permanent magnet 120 so that it may extend beyond the periphery of the magnet, and is adhered to the magnet 120 by an adhesive. The working air gap 104 surrounds core cap 122 and spans the distance between the core cap 122 and the adjacent inside surface of the shell-pot 118.

The magnetic circuit 102 is formed as the magnet 120 generates a magnetic field and the core cap 122 and shell-pot 118 each provide a path from the opposite poles of the permanent magnet 120 for carrying and directing the magnetic field into the air gap 104.

A cross-section of a typical core cap 122 is shown in FIG. 2. As is illustrated, a small circular groove 202 has a diameter that is slightly less than the diameter of the core cap 122, so that the groove 202 is near to the perimeter of the core cap 122. The groove 202 is formed in the surface or face 201 of the core cap 122 that is to be adhered to the permanent magnet 120. The purpose of the groove 202, which is commonly referred to as an adhesive control groove, is to act as a reservoir for collecting any excess adhesive and prevent the adhesive from "squeezing out" from between the magnet 120 and core cap 122 and into the air gap 104 during assembly.

The opposite face 203 of the core cap 122 also includes a second and identical adhesive control groove 200. The additional groove 200 eliminates any need to particularly orient the core cap 122 prior to its assembly to the permanent magnet 120 and, thus, makes the assembly process error-proof in this regard. Though convenient for manufacturing, the additional groove 200 may create unintended problems in the operation of the core cap. It is therefore desirable to provide a core cap that not only possesses the features advantageous for the manufacturability of the loudspeaker (e.g., take an adhesive reservoir and assembly orientation error-proofing) but also reduces unintended problems in the operation of the core cap.

SUMMARY

The core cap of the prior art creates the unintended consequence of reducing the ability to carry magnetic flux from the permanent magnet 120 into the working air gap 104. By narrowing the cross-section, (as shown at location 204 in FIG. 2) the reluctance of the core cap 122 is effectively increased. Consequently, the core cap's 122 ability to carry magnetic flux is reduced. Accordingly, the invention provides an improved top plate or core cap for use with loudspeakers having a shell-pot design that includes offset adhesive control grooves on the opposite faces of the disk-like core cap.

With the improved core cap design, the magnetic reluctance added by the grooves may be reduced by approximately 50 percent. This reduction in reluctance is accomplished by offsetting, along at least a portion of the grooves, the position of the grooves relative to one another. The grooves may be offset or staggered by an amount that is sufficient to increase the smallest dimension between any feature of the grooves to about the nominal thickness of the core cap. Offsetting the adhesive control grooves diminishes the cross-sectional reduction in the core cap to the equivalent of having only a single groove (i.e., a groove on only one surface of the core cap) yet maintains the assembly error-proofing of having adhesive control grooves on both surfaces of the core cap. Consequently, the core cap of this invention provides a magnetic advantage over the prior art, while maintaining the assembly advantage of core cap orientation error-proofing.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
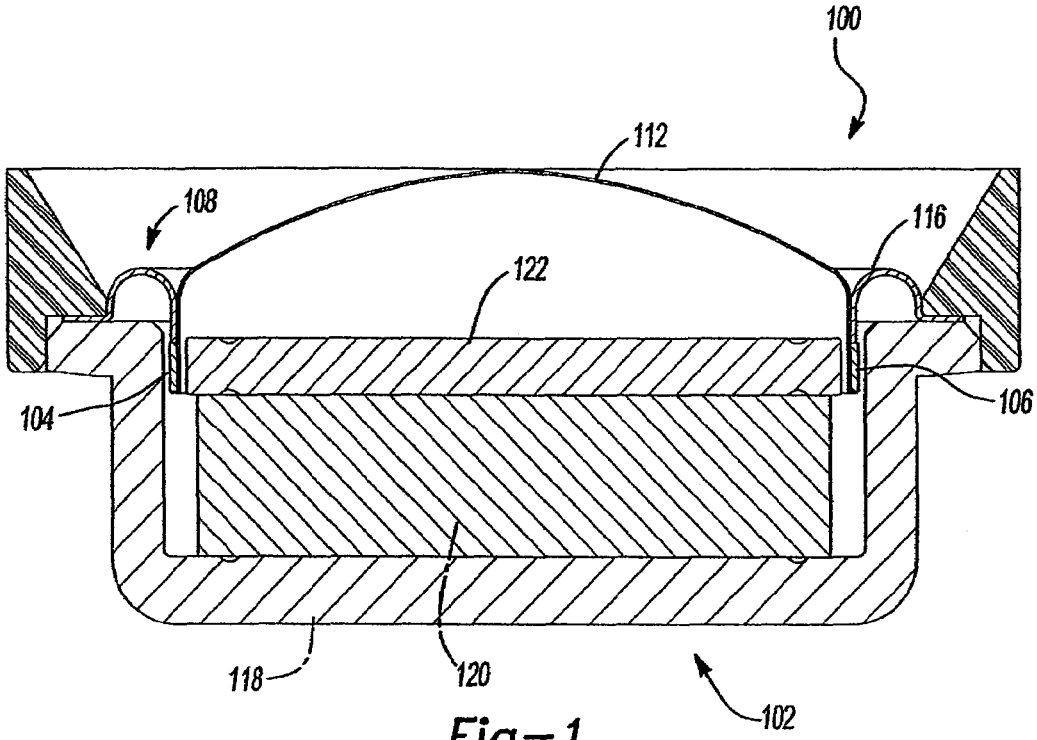
Fig-1 PRIOR ART
FIG. 1 illustrates a simplified cross-sectional front view of a loudspeaker of a shell-pot-type design that is constructed with a core cap that is known in the prior art.

As discussed in the background, the adhesive control grooves 200 and 202 allow for easier manufacturing since the orientation of the cap is error proof. However, the orientation of the control grooves 200 and 202 may cause unintended problems in the core cap 122. Examining the core cap shown in FIG. 2, the core cap 122 is "necked down," having a cross-sectional dimension 204 that is smaller than the core cap's 122 nominal thickness T. This is due to the radial location of the two adhesive control grooves 200 and 202 on the opposing surfaces 201 and 203 of the core cap 122. The amount that the thickness of the core cap 122 is reduced is simply the sum of the depths d, of the opposing grooves 200 and 202 (i.e., 2d). In loudspeaker applications where the nominal thickness T of the core cap 122 is already relatively thin (e.g., in tweeters), the sum of the depths d of the opposing grooves 200 and 202 can be a significant percentage of the nominal thickness T of the core cap 122. It is not uncommon for the thickness of the core cap 122 to be reduced by as much as 25 percent or more from its nominal thickness T at the radial location of the opposing adhesive control grooves 200 and 202.

The necked-down cross-section of the core cap 122 has a detrimental magnetic effect on the performance of the core cap 122 from the stand point of its ability to carry the magnetic flux from the permanent magnet 120 into the working air gap 104. By narrowing the cross-section, (as at location 204) the reluctance of the core cap 122 is effectively increased. Consequently, the core cap's 122 ability to carry magnetic flux is reduced. When the magnetic energy generated by the permanent magnet 120 exceeds the magnetic flux capacity of the core cap 122, the core cap 122 becomes magnetically "saturated." When magnetic saturation in the core cap 122 occurs, the amount of magnetic energy that can be carried in the entire magnetic circuit 102 is decreased and magnetic leakage and fringing (i.e., when magnetic flux departs from the closed path of the magnetic circuit 102) is increased. Ultimately the flux density of the magnetic field channeled to the working air gap 104 of the loudspeaker 100 is reduced.

Figure 3:
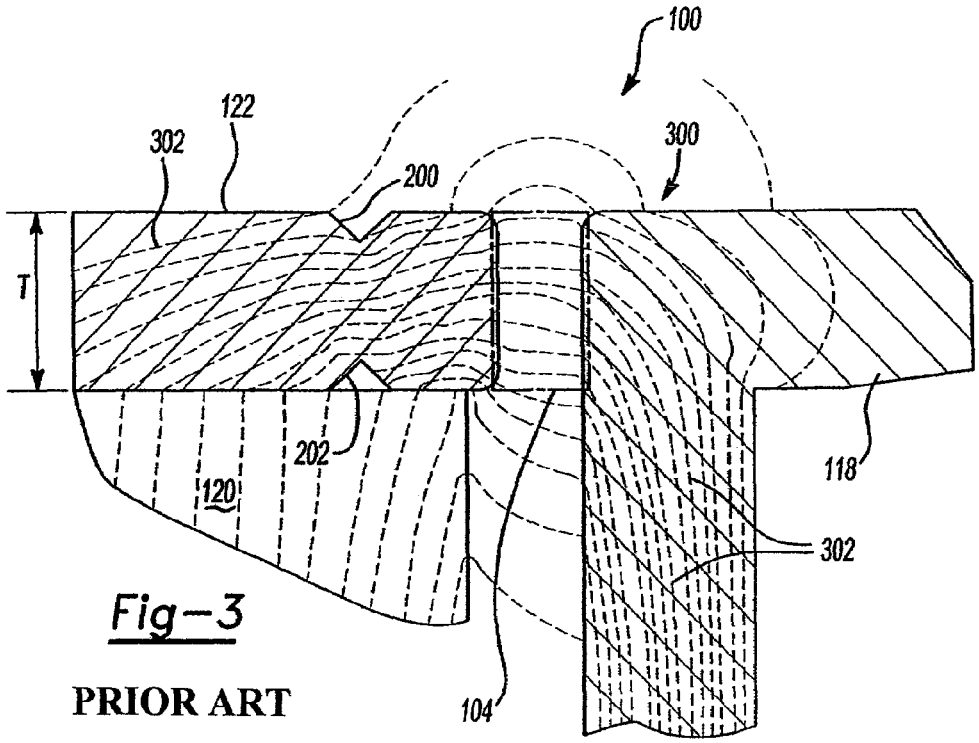
Fig-3 PRIOR ART
FIG. 3 illustrates an enlarged cross-sectional view of a portion of the loudspeaker of FIG. 1 depicting a graphic representation of the magnetic flux density in the working air-gap of the loudspeaker.

In FIG. 3, the magnetic flux density 300 in the working air gap 104 of the loudspeaker 100 having a core cap 122 of the prior art design is shown. Individual lines of magnetic flux are indicated as dashed lines (e.g., 302). The magnetic circuit 102 occupies a closed path from the permanent magnet 120 through the core cap 122 across the air gap 104 to the shell-pot 118 and finally returning to the magnet 120, closing the circuit. In the core cap 122, the magnetic circuit 120 does not occupy the airspace in the cross-section of the adhesive control grooves 200 and 202, as shown. This is because air has a greater reluctance than the adjacent core cap 122.

The opposed adhesive control grooves 200 and 202 increase the reluctance of the core cap 122 and reduce the amount of magnetic flux 300 that is located in the working air gap 104. The effective reduction in magnetic flux 300 density is caused by the magnetic saturation of the core cap 122, which has an effective cross-sectional thickness of the nominal thickness T of the core cap 122 minus the sum of the depths d of the two grooves 200 and 202.

Figure 2:
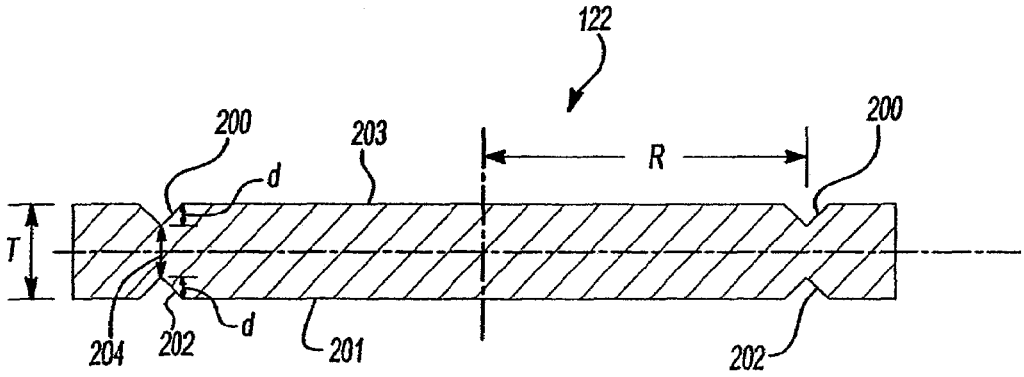
Fig-2 PRIOR ART
FIG. 2 is a cross-sectional front view of the core cap shown in FIG. 1.
Figure 4:
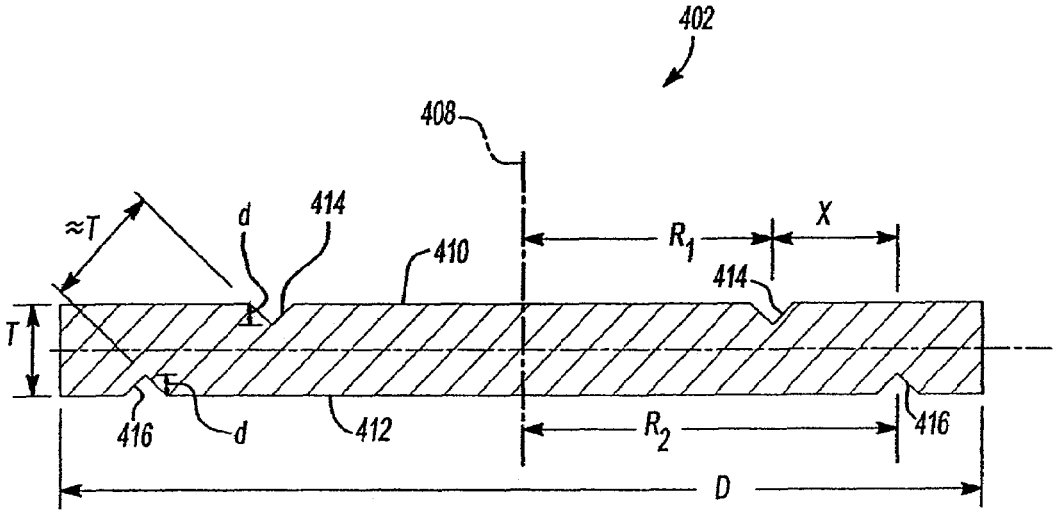
FIG. 4 is a cross-sectional front view of a core cap constructed according to the principles of the invention.

FIG. 4 shows one example of a core cap 402 that not only possesses the features advantageous for the manufacturability of the loudspeaker (e.g., take an adhesive reservoir and assembly orientation error-proofing) but also decreases the reluctance over the prior art core cap design 122, shown in FIGS. 1-3, and thereby increases the magnetic flux density in the working air gap of the loudspeaker. The core cap 402 is generally disk-shaped with a diameter D, a nominal thickness T, and a longitudinal centerline 408. The core cap 402 has a substantially flat first surface or face 410. Opposite of the first face is a substantially flat second surface or face 412.

Located in each of the first and second faces 410 and 412 of the core cap 402, respectively, are first and second adhesive control grooves 414 and 416. Grooves 414 may comprise any type of channel, furrow, rut, indentation, or the like, which as already described, function to serve as a reservoir to collect any excess adhesive that is used to attach the core cap 402 to the magnet 120 and thereby prevent the adhesive from squeezing out from between the two components and into the working air gap 104 of the loudspeaker.

The adhesive control grooves 414 and 416 are shown in the figures to be shaped with a V-shaped cross-section. The cross-sectional configuration of the adhesive control groove 414 and 416 may have other cross-section shapes, such as a polygonal, square, rectangular, triangular, arcuate, ellipsoidal, or circular cross-section. Moreover, the cross-sectional shape of the grooves may depend on the manufacturing technique that is used to form the grooves 414 and 416. The adhesive control grooves 414 and 416 may be formed in the core cap 402 utilizing any of a number of manufacturing techniques, such as milling or stamping, for example. Consequently, cross-sectional configurations other than that shown may be readily employed in the improved core cap design 402, without departing from the scope of the subject invention.

Moreover, the depth d of each of the respective adhesive control grooves 414 and 416 is sufficient to further the grooves' 414 and 416 manufacturability purpose. In this regard, the depth d of one of the adhesive control grooves 414 and 416 may, itself, be as much as 12.5 percent of the nominal thickness T of the core cap 402. Further, the depth d may be uniform across the entire length of the groove or may vary.

In the core cap as illustrated FIG. 4, each of the adhesive control grooves 414 and 416 is generally annular and circular in shape. Unlike the prior art core cap designs, however, the groove 414 is offset from the groove 416 along at least a portion of the groove 414. As shown in FIG. 4, the groove 414 is offset from the groove 416 along the entire portion of the groove 414 since each adhesive control groove 414 and 416 is formed at a different radii, as measured from the longitudinal centerline 408 of the core cap 402. The first groove 414 located on the first face 410 has a radius $R_1$, and the second groove 416 on the second face 412 has a radius $R_2$, where $R_2$ is greater than $R_1$ . Therefore, the first groove 414 and the second groove 416 are symmetric about the centerline 408 of the core cap 402.

Consequently, the first and second adhesive control grooves 414 and 416 are offset from one another by an offset distance X, i.e., the difference between their respective radii, $(R_2-R_1)$. In this configuration, then, the reduction in the nominal thickness T 406 of the core cap 402 is reduced by 50 percent over the prior art core cap design (i.e., the effective thickness of the core cap at a location of a groove is increased from (T−2d) to (T−d)). In addition, the distance X may be such that the smallest dimension between any feature of the two opposing grooves 414 and 416 is approximately or substantially the nominal thickness T of the core cap 402. By way of example, and not limitation, the offset distance X may generally be between about 50 percent to about 85 percent of the thickness T of the core cap 402, may generally be less than two-thirds the thickness T of the core cap 402, or may generally be greater than two-thirds the thickness T of the core cap 402.

Figure 5:
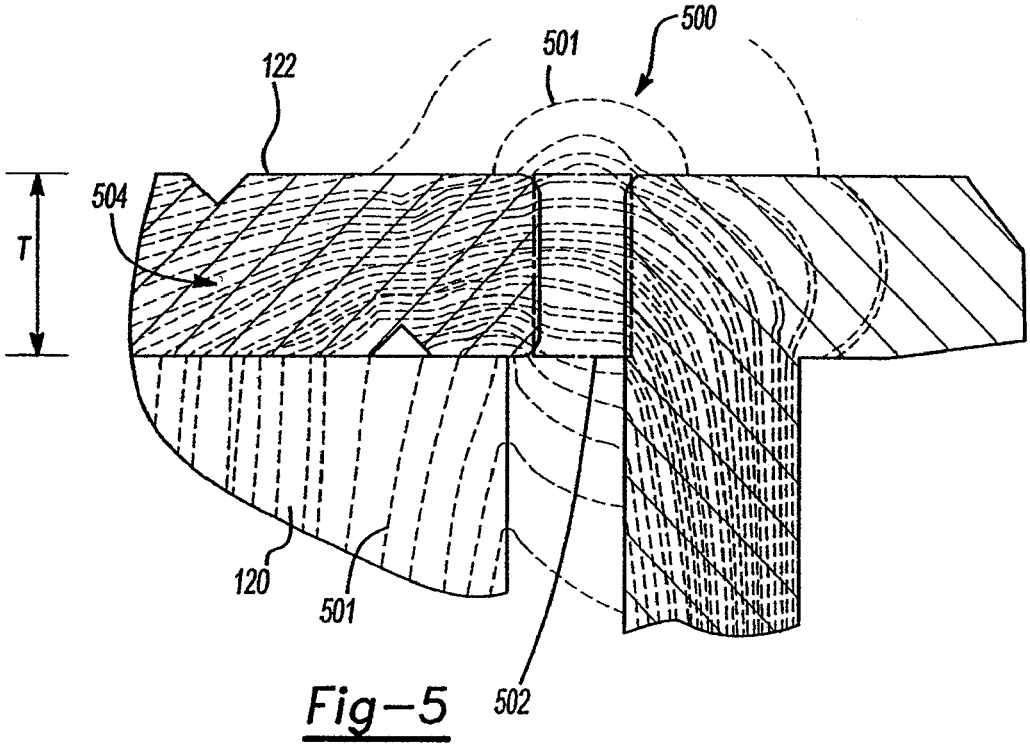
FIG. 5 shows an enlarged cross-sectional view of a portion of a loudspeaker incorporating the core cap of FIG. 4 depicting a graphic representation of the magnetic flux density in the working air-gap of the loudspeaker.

In FIG. 5, a graphic representation of the magnetic flux density 500 in the working air-gap 502 of a loudspeaker 504 comprising the core cap 402 is shown. Individual lines of magnetic flux are indicated as dashed lines, e.g., 501. The ultimate effect of the offset distance X between the opposing adhesive control grooves 414 and 416 of the core cap 402 is to increase the density of the magnetic flux 501 that is present in the working air gap 502 of the loudspeaker 504 without changing the strength of the permanent magnet 120.

Figure 6:
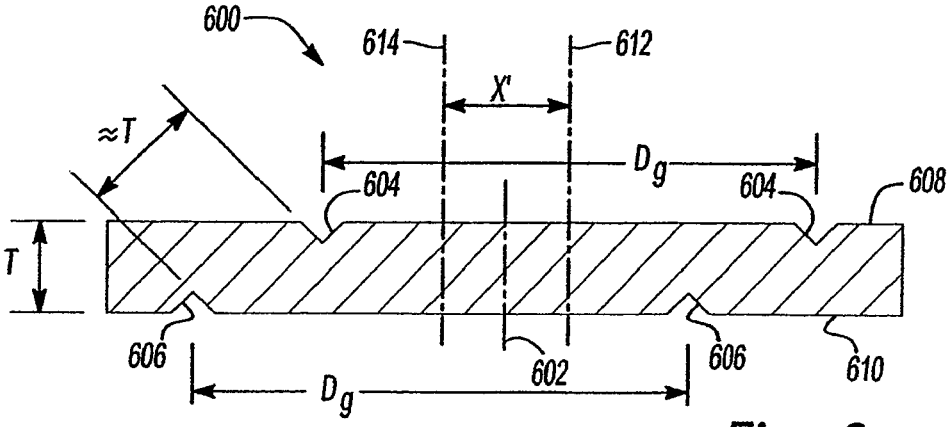
FIG. 6 is a cross-sectional front view of an alternate construction of a core cap according to the principles of the invention.

Alternatively, the loudspeaker may include a core cap 600 as shown in FIG. 6. The core cap 600 generally includes the same features as the core cap 402 previously described and shown in FIG. 4. In this alternative core cap 600, however, both of the annular adhesive control grooves 604 and 606 that are located in the opposing faces of the core cap 608 and 610 have the same diameter $D_g$. Their respective centerlines 612 and 614, however, are offset by a distance X'. Such a configuration utilizing the same diameter $D_g$ for the adhesive control grooves 604 and 606 may be desirable from the standpoint of manufacturing the core cap 600, as in tooling or process set-up, for example. Alternatively, the annular control grooves may comprise circles with different centers and different radii.

Figure 7:
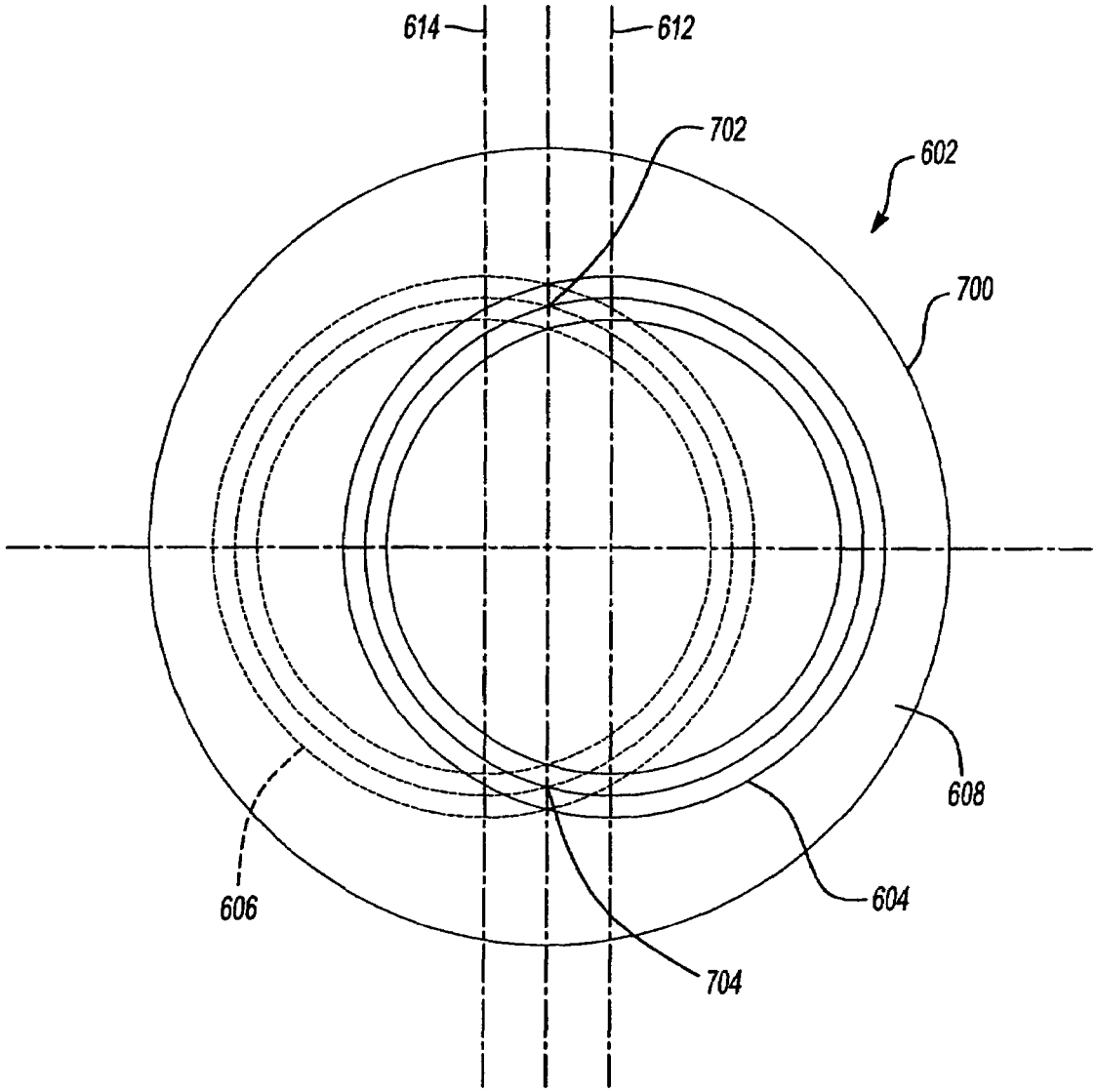
FIG. 7 is a plan view of the core cap of FIG. 6.

As shown in FIG. 7, the grooves 604 and 606 are asymmetric about the centerline 602 of the core cap 600. Further, as shown in FIG. 7, however, the offset distance X' between the opposing grooves 604 and 606 will vary about the perimeter 700 of the core cap 600. In this regard, the effective offset distance will vary between a maximum offset distance of X' to a minimum offset distance of zero, as shown at locations 702 and 704. Therefore, the groove 604 is offset from the groove 606 along only a portion, and not all, of the groove 604. Notwithstanding, however, an overall beneficial effect is still achieved in the loudspeaker with this core cap design 600 over that of the prior art.

While various embodiments of the invention have been described, it will be apparent to those of ordinary skill in the art that other embodiments and implementations are possible that are within the scope of this invention. Accordingly, the invention is not restricted except in light of the attached claims and their equivalents.

What is claimed is:

1. A core cap for a loudspeaker of a shell-pot-type design, the core cap having a longitudinal axis and a nominal thickness, comprising:

a first face including a first groove; and a second face including a second groove;

where, along at least a portion of the first groove, the first groove is offset from the second groove in a direction that is transverse the longitudinal axis.

2. The core cap as set forth in claim 1 where the core cap is disk-shaped and the first and second grooves are annular.

3. The core cap as set forth in claim 2 where the first annular groove has a first radius;

the second annular groove has a second radius; and the first radius is greater than the second radius.

4. The core cap as set forth in claim 3 where the first groove is radially offset from the second groove by a distance such that a smallest dimension between any feature of the two opposing grooves is greater than the nominal thickness of the core cap.

5. The core cap as set forth in claim 3 where the first groove is radially offset from the second groove by a distance such that a smallest dimension between any feature of the two opposing grooves is substantially equal to the nominal thickness of the core cap.

6. The core cap as set forth in claim 3 where the first groove is radially offset from the second groove by a distance such that a smallest dimension between the two opposing grooves is substantially the nominal thickness of the core cap.

7. The core cap as set forth in claim 2 where the first annular groove has a first diameter;

the second annular groove has a second diameter; and the first diameter is equal to the second diameter.

8. The core cap as set forth in claim 7 where the first diameter has a first centerline and the second diameter has a second centerline, and where the first centerline is offset from the second centerline.

9. The core cap as set forth in claim 7 where the first groove is offset from the second groove by a distance such that a smallest dimension between any feature of the two opposing grooves is greater than the nominal thickness of the core cap.

10. The core cap as set forth in claim 7 where the first groove is offset from the second groove by a distance such that a smallest dimension between any feature of the two opposing grooves is substantially equal to the nominal thickness of the core cap.

11. The core cap as set forth in claim 7 where the first groove is offset from the second groove by a distance such that a smallest dimension between the two opposing grooves is substantially the nominal thickness of the core cap.

12. The core cap as set forth in claim 1 where a cross-sectional shape of at least the one of the first and second grooves is selected from the group consisting of polygonal, square, rectangular, triangular, arcuate, ellipsoidal and circular.

13. The core cap as set forth in claim 1 where the first groove is offset from the second groove by a distance greater than two-thirds of the nominal thickness of the core cap.

14. The core cap as set forth in claim 1 where the first groove is offset from the second groove by a distance that is between 50 percent and 85 percent of the nominal thickness of the core cap.

15. The core cap as set forth in claim 1 where the first groove is offset from the second groove by a distance less than two-thirds of the nominal thickness of the core cap.

16. The core cap as set forth in claim 1 where the first groove is offset from the second groove along the entire first groove.

17. The core cap as set forth in claim 1 where the first groove is offset from the second groove only along the portion of the first groove.

18. A core cap for a loudspeaker, the core cap having a centerline and a nominal thickness, the core cap comprising:

a first face including a first annular groove; and a second face including a second annular groove, the first annular groove having a first radius;

the second annular groove having a second radius;

the first radius being different than the second radius, such that the first groove is offset from the second groove in a direction that is transverse the centerline.

19. The core cap as set forth in claim 18 where the first groove is offset from the second groove by a distance such that the smallest dimension between any feature of the two opposing grooves is greater than the nominal thickness of the core cap.

20. The core cap as set forth in claim 18 where the first groove is offset from the second groove by a distance such that the smallest dimension between any feature of the two opposing grooves is substantially equal to the nominal thickness of the core cap.

21. The core cap as set forth in claim 18 where the first groove is offset from the second groove by a distance such that the smallest dimension between the two opposing grooves is substantially the nominal thickness of the core cap.

22. The core cap as set forth in claim 18 where the cross-sectional shape of at least the one of the first and second grooves is selected from the group consisting of polygonal, square, rectangular, triangular, arcuate, ellipsoidal and circular.

23. The core cap of claim 18 where the first and second grooves are asymmetric about the centerline of the core cap.

24. The core cap of claim 18 where the first and second grooves are symmetric about the centerline of the core cap.

25. A loudspeaker, comprising:

a support structure;

a magnetic circuit; and a sound reproducing apparatus;

the magnetic circuit for providing a magnetic field in a working air gap, the magnetic circuit comprising a permanent magnet and a top plate affixed to the magnet;

the top plate having a centerline and being sized to extend beyond the periphery of the magnet, the top plate comprising:

a first face including a first groove; and a second face including a second groove;

where, along at least a portion of the first groove, the first groove is offset from the second groove in a direction that is transverse the centerline.

26. The loudspeaker of claim 25 where the support structure includes a frame rigidly fixed to a lipped radial basin and a surround which couples the sound reproducing section to the frame, and the lipped radial basin supports the magnet and provides an air gap.

27. The loudspeaker of claim 25 where the first groove is offset from the second groove along the entire first groove.

28. The loudspeaker of claim 25 where the first groove is offset from the second groove only along the portion of the first groove.

* * * * *